US010183822B2

(12) United States Patent
Ishii et al.

(10) Patent No.: US 10,183,822 B2
(45) Date of Patent: Jan. 22, 2019

(54) SHEET FEEDING UNIT, SHEET FEEDING APPARATUS INCLUDING SHEET FEEDING UNIT, AND IMAGE FORMING APPARATUS INCLUDING SHEET FEEDING APPARATUS

(71) Applicant: CANON KABUSHIKI KAISHA, Tokyo (JP)

(72) Inventors: Hirotaka Ishii, Suntou-gun (JP); Masato Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/790,419

(22) Filed: Oct. 23, 2017

(65) Prior Publication Data

US 2018/0118479 A1 May 3, 2018

(30) Foreign Application Priority Data

Oct. 27, 2016 (JP) ..... 2016-211022

(51) Int. Cl.
*B65H 3/04* (2006.01)
*B65H 3/06* (2006.01)
(Continued)

(52) U.S. Cl.
CPC ..... *B65H 3/04* (2013.01); *B65H 1/04* (2013.01); *B65H 3/047* (2013.01); *B65H 3/0638* (2013.01); *B65H 3/0669* (2013.01); *G03G 15/6514* (2013.01); *B65H 2301/42262* (2013.01); *B65H 2402/31* (2013.01); *B65H 2403/21* (2013.01); *B65H 2404/251* (2013.01);
(Continued)

(58) Field of Classification Search
CPC . B65H 3/04; B65H 3/047; B65H 3/52; B65H 3/5253; B65H 3/5261
USPC ..... 271/34
See application file for complete search history.

(56) References Cited

U.S. PATENT DOCUMENTS 3,966,189 A 6/1976 Taylor
4,750,730 A * 6/1988 Nilsson ..... B65H 3/10 271/108
(Continued)

FOREIGN PATENT DOCUMENTS

JP S51-051337 A 5/1976
JP S56-048342 A 5/1981
(Continued)

*Primary Examiner* — David H Bollinger
(74) *Attorney, Agent, or Firm* — Canon U.S.A., Inc. IP Division

(57) ABSTRACT

A sheet feeding unit, attached to a sheet feeding apparatus that feeds a sheet, includes an endless belt, first and second rotary members, and a holding device. The endless belt contacts a sheet stacked on a stacking device to feed the sheet. The first and second rotary members contact an inner periphery of the endless belt to support the endless belt. The second rotary member faces, via the endless belt, a separation device that separates the sheet from the endless belt. The holding device holds the first and second rotary members. The endless belt includes protruding and depressed portions on the inner periphery. The second rotary member includes protruding and depressed driving portions that mesh with the protruding and depressed portions to transmit a driving force to the endless belt to, in turn, rotate the endless belt to feed the sheet in contact with the endless belt.

21 Claims, 11 Drawing Sheets

(51) Int. Cl.
*G03G 15/00* (2006.01)
*B65H 1/04* (2006.01)

(52) U.S. Cl.
CPC ..... *B65H 2404/252* (2013.01); *B65H 2404/2693* (2013.01); *B65H 2405/324* (2013.01); *B65H 2407/21* (2013.01); *B65H 2513/50* (2013.01); *B65H 2601/324* (2013.01); *G03G 2221/1696* (2013.01)

(56) References Cited

U.S. PATENT DOCUMENTS

| | | | | | |
|---|---|---|---|---|---|
| 4,826,337 | A * | 5/1989 | Unuma | B41J 11/30 | 226/74 |
| 4,960,273 | A * | 10/1990 | Frystak | B65H 1/04 | 271/10.06 |
| 7,192,025 | B1 * | 3/2007 | Golicz | B65H 1/22 | 271/34 |
| 2001/0028143 | A1 * | 10/2001 | Bantle | B65H 3/047 | 271/34 |
| 2011/0200375 | A1 * | 8/2011 | Kokawa | B41J 3/4075 | 400/578 |

FOREIGN PATENT DOCUMENTS

| | | | |
|---|---|---|---|
| JP | S61-060546 | A | 3/1986 |
| JP | 04-251041 | A | 9/1992 |
| JP | 04350031 | A * | 12/1992 |
| JP | 07-25490 | A | 1/1995 |
| JP | 2006341971 | A | 12/2006 |
| JP | 2008024463 | A | 2/2008 |
| JP | 2010105807 | A | 5/2010 |
| JP | 201567392 | A | 4/2015 |

* cited by examiner

SHEET FEEDING UNIT, SHEET FEEDING APPARATUS INCLUDING SHEET FEEDING UNIT, AND IMAGE FORMING APPARATUS INCLUDING SHEET FEEDING APPARATUS

BACKGROUND OF THE INVENTION

Field of the Invention

The disclosed information relates to a sheet feeding apparatus configured to feed sheets and an image forming apparatus including the same.

Description of the Related Art

Conventional image forming apparatuses, such as electrophotographic copying machines, electrophotographic printers such as light emitting diode (LED) printers and laser beam printers, electrophotographic facsimile apparatuses, and electrophotographic word processors, have been widely used. The conventional image forming apparatuses include a sheet feeding apparatus therein. Sheets are fed from the sheet feeding apparatus to an image forming unit to form images on the fed sheets.

A so-called manual sheet feeding apparatus is an example of such a sheet feeding apparatus. A user sets a sheet on a manual sheet feeding tray, and the sheet is fed to an image forming unit by a sheet feeding roller of a sheet feeding unit.

In general, the manual sheet feeding tray is stored in a front or side portion of the manual sheet feeding apparatus and is attached so as to be openable and closable, and a user opens the tray to use the apparatus. When the manual sheet feeding apparatus is used, the user sets a sheet on the manual sheet feeding tray, and the sheet is fed to the image forming unit by the sheet feeding rollers.

Japanese Patent Application Laid-Open No. 2015-67392 discusses a manual sheet feeding apparatus capable of continuously feeding sheets. To convey the sheets one by one into the main body of the apparatus, the manual sheet feeding apparatus includes a sheet feeding roller, a sheet conveying roller which conveys a sheet fed by the sheet feeding roller, and a separation roller which separates the sheet from the sheet conveying roller. Specifically, the sheet feeding roller and the sheet conveying roller are pivotably supported as a sheet feeding unit, and the sheet feeding unit can swing about a shaft of the sheet conveying roller which is a rotation center. The sheet feeding roller and a portion of the sheet feeding unit that holds the sheet feeding roller protrude laterally from the main body of the apparatus as the manual sheet feeding tray is opened. When the manual sheet feeding tray is closed, the sheet feeding roller and the manual sheet feeding tray come into contact with each other to rotate toward the main body of the apparatus as an operation to close the manual sheet feeding tray is performed, and consequently, the sheet feeding roller and the portion of the sheet feeding unit that holds the sheet feeding roller are stored in the main body of the apparatus.

In recent years, image forming apparatuses have been required to be smaller, and this brings demands for reduction in size of sheet feeding units. The technique discussed in Japanese Patent Application Laid-Open No. 2015-67392 requires a space in the main body of the apparatus for storing the sheet feeding roller and the portion of the sheet feeding unit that holds the sheet feeding roller when the manual sheet feeding tray is stored in the main body of the apparatus, and this makes it difficult to reduce the size of the image forming apparatus. Further, reducing the size of the sheet feeding roller to reduce the size of the sheet feeding unit may lead to a sheet feeding failure depending on the type of a sheet.

SUMMARY OF THE INVENTION

The disclosed information is directed to a sheet feeding unit which is reduced in size and capable of feeding sheets successfully, a sheet feeding apparatus including the sheet feeding unit, and an image forming apparatus.

According to an aspect of the present invention, a sheet feeding unit attachable to and removable from a sheet feeding apparatus configured to feed a sheet includes an endless belt configured to be brought into contact with a sheet stacked on a stacking device to feed the sheet, a first rotary member configured to come into contact with an inner periphery of the endless belt to support the endless belt, a second rotary member configured to come into contact with the inner periphery of the endless belt to support the endless belt and disposed to face, via the endless belt, a separation device configured to separate the sheet from the endless belt, and a holding device configured to hold the first rotary member and the second rotary member, wherein the endless belt includes a plurality of protruding and depressed portions on the inner periphery of the endless belt, and the second rotary member includes a plurality of protruding and depressed driving portions configured to mesh with the plurality of protruding and depressed portions of the endless belt, and wherein, to rotate the endless belt to feed the sheet in contact with the endless belt, the plurality of protruding and depressed portions meshes with the plurality of protruding and depressed driving portions to transmit a driving force from the plurality of protruding and depressed driving portions to the endless belt.

Further features of the present invention will become apparent from the following description of embodiments with reference to the attached drawings.

DESCRIPTION OF THE EMBODIMENTS

Various embodiments will be described in detail below with reference to the drawings. It should be noted, however, that the sizes, materials, shapes, relative positions, etc. of components described in the embodiments are not intended to limit the scope of the invention to the embodiments but should be changed as appropriate according to the structure of an apparatus to which an embodiment of the present invention is applied and various conditions.

Figure 1:
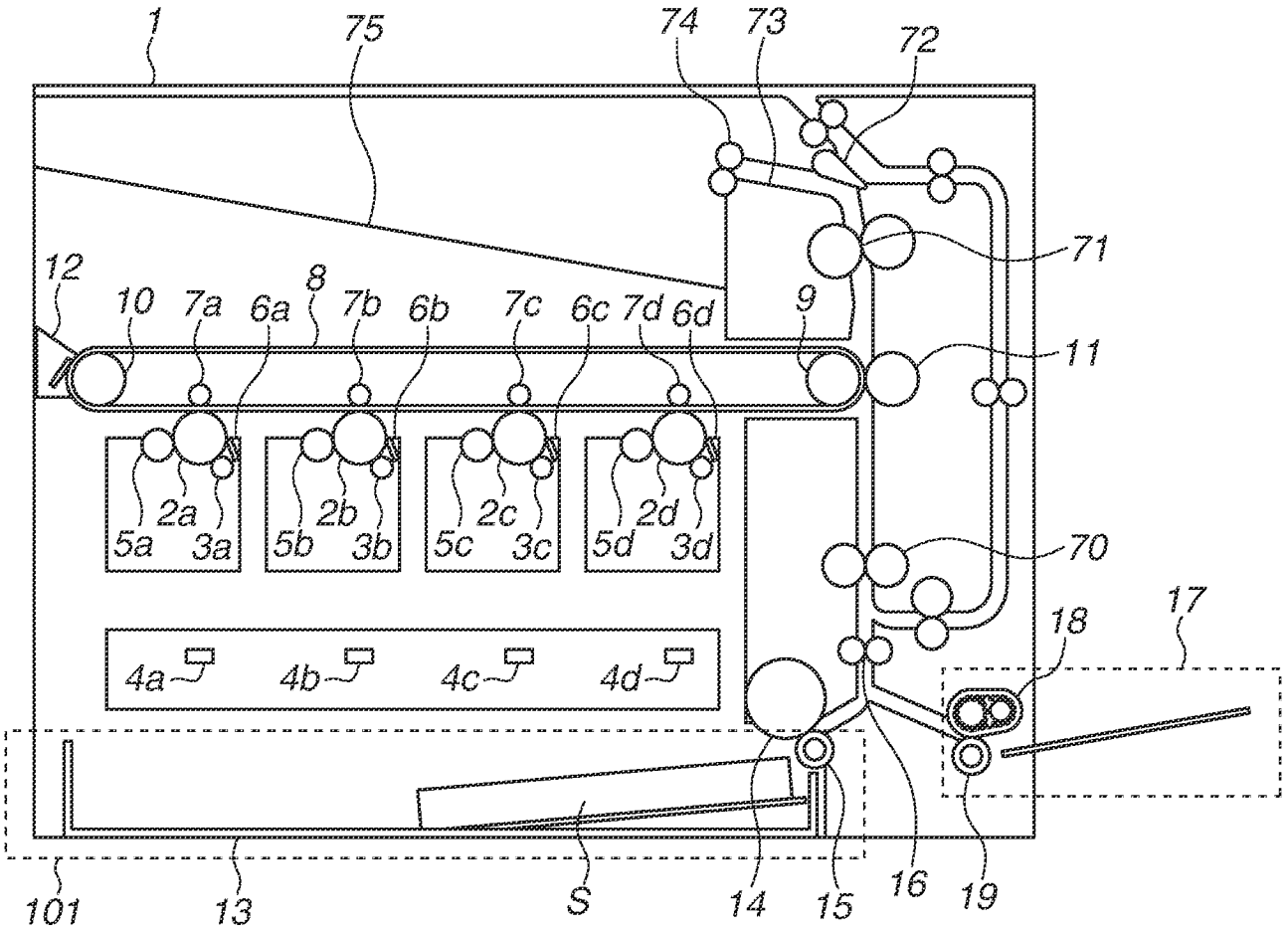
FIG. 1 is a cross-sectional view schematically illustrating an image forming apparatus according to a first embodiment.

FIG. 1 is a cross-sectional view illustrating the structure of a laser printer which is an example of an image forming apparatus including a sheet feeding apparatus according to a first embodiment.

An image forming apparatus 1 has a main body including four photosensitive drums 2 (2*a*, 2*b*, 2*c*, 2*d*) which are drum-shaped image bearing members arranged next to each other in a substantially horizontal direction. The photosensitive drums 2 are driven and rotated clockwise in FIG. 1 by a driving member (not illustrated). Further, charging devices 3 (3*a*, 3*b*, 3*c*, 3*d*) and scanner units 4 (4*a*, 4*b*, 4*c*, 4*d*) are provided. The charging devices 3 uniformly charge the surfaces of the photosensitive drums 2. The scanner units 4 irradiate the photosensitive drums 2 with laser beams based on image information to form electrostatic latent images on the photosensitive drums 2. Further, development devices 5 (5*a*, 5*b*, 5*c*, 5*d*) and cleaning devices 6 (6*a*, 6*b*, 6*c*, 6*d*) are provided. The development devices 5 apply toner including a development agent to the electrostatic latent images to develop the images into toner images. The cleaning devices 6 remove residual untransferred toner remaining on the photosensitive drums 2 after the transfer.

The photosensitive drums 2, the charging devices 3, the development devices 5, and the cleaning devices 6 are integrated as cartridge units to form images of different colors (yellow, cyan, magenta, black) by an electrophotographic method. While the cartridge units are image forming units configured to form an image to be transferred onto a sheet according to the present embodiment, the image forming units may have a different structure. For example, the development devices 5 and the photosensitive drums 2 may be separate units.

Primary transfer rollers 7 (7*a*, 7*b*, 7*c*, 7*d*) are in contact with the photosensitive drums 2 via an intermediate transfer belt 8. The toner images on the photosensitive drums 2 are transferred onto the intermediate transfer belt 8.

The intermediate transfer belt 8 is extended between a driving roller 9 and a tension roller 10. The intermediate transfer belt 8 is rotated counterclockwise by the driving of the driving roller 9. A secondary transfer roller 11 disposed to face the driving roller 9 via the intermediate transfer belt 8 transfers onto a sheet S the toner images transferred on the intermediate transfer belt 8.

Further, a belt cleaning device 12 is disposed to face the tension roller 10 via the intermediate transfer belt 8. The belt cleaning device 12 removes and collects residual untransferred toner remaining on the surface of the intermediate transfer belt 8.

A first sheet feeding apparatus 101 is provided below the intermediate transfer belt 8. The first sheet feeding apparatus 101 includes at least a sheet feeding cassette 13 for storing sheets, a cassette (CST) sheet feeding roller 14, and a CST separation roller 15. In addition to the first sheet feeding apparatus 101, a multi-sheet feeding apparatus 17 and a pair of registration rollers 70 are provided to feed and convey the sheets S. The multi-sheet feeding apparatus 17 is a second sheet feeding apparatus and is provided to a lower right portion of the image forming apparatus 1. The pair of registration rollers 70 corrects skew of sheets S.

A fixing device 71 fixes the toner images formed on the sheet S by the image forming units of the respective colors via the intermediate transfer belt 8. A double-sided flapper 72 is a sheet conveying path changing member and guides a sheet to a sheet-to-be-discharged conveying path 73 when only one side of the sheet is to be printed. A pair of sheet discharging rollers 74 discharges the sheet S onto a sheet discharging tray 75 which is a sheet stacking device.

Next, operations of the image forming apparatus will be described below. A sheet feeding belt 18 and a separation roller 19, which is a separation device, separate one by one a predetermined number of sheets S stacked on the multi-sheet feeding apparatus 17. Each separated sheet is conveyed to a drawing roller 16. Similarly, the CST sheet feeding roller 14 and the CST separation roller 15 separate one by one a predetermined number of sheets stacked on the sheet feeding cassette 13 and convey each separated sheet to the drawing roller 16. The drawing roller 16 conveys a sheet S to the pair of registration rollers 70 and then to a contact portion of the intermediate transfer belt 8 and the secondary transfer roller 11. The toner images transferred from the image forming units of the respective colors onto the intermediate transfer belt 8 are transferred onto the sheet S at the contact portion of the intermediate transfer belt 8 and the secondary transfer roller 11 to form a color image, and then the sheet S is conveyed to the fixing device 71.

The fixing device 71 applies heat and pressure to the toner image transferred on the sheet S. The sheet S on which the toner image of the plurality of colors is thus fixed is guided by the double-side flapper 72 to the sheet-to-be-discharged conveying path 73, conveyed through the pair of sheet discharging rollers 74, and then discharged onto the sheet discharging tray 75.

Next, the multi-sheet feeding apparatus 17, which is the second sheet feeding apparatus of the image forming apparatus 1, will be described in detail below with reference to FIGS. 2, 3, and 4.

Figure 2:
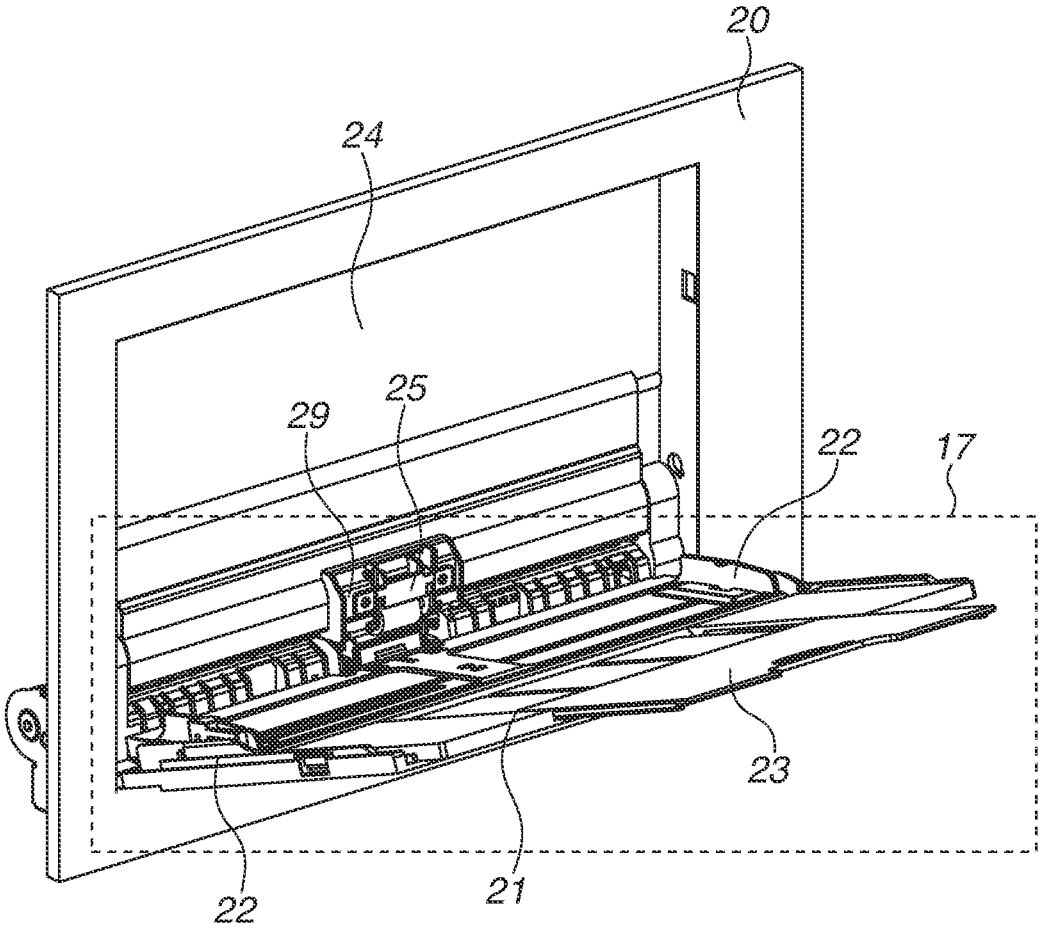
FIG. 2 is a perspective view illustrating the structure of a right door according to the first embodiment.

FIG. 2 is a perspective view illustrating in detail a right door 20 which is an openable/closable member including the multi-sheet feeding apparatus 17. The right door 20 is provided on the right-side surface of the image forming apparatus 1 such that the right door 20 is freely openable and closable with respect to the image forming apparatus 1. Further, a sheet feeding tray 21, which is a stacking device, is provided such that the sheet feeding tray 21 is freely openable and closable with respect to the right door 20. A side regulation plate 22 is provided on the sheet feeding tray 21 and regulates both end portions of the sheets S stacked on the sheet feeding tray 21 to convey the sheets S straight to the image forming apparatus 1. An extension tray 23 is normally stored in the sheet feeding tray 21, and when a long sheet is to be used, a user pulls the extension tray 23 toward the outside to use the extension tray 23. A sheet feeding tray storage member 24 is provided on the right door 20 and includes a depressed portion to store the sheet feeding tray 21 and the components of the sheet feeding tray 21, such as the side regulation plate 22 and the extension tray 23, when the sheet feeding tray 21 is closed.

A sheet feeding unit 25 is a unit including the sheet feeding belt 18, which is an endless belt, and is removable from and attachable to an attachment portion 29. The sheet feeding unit 25 is disposed in such a way that the sheet feeding unit 25 is invisible from the user due to the presence of the sheet feeding tray 21 when the sheet feeding tray 21 is closed with respect to the right door 20.

The multi-sheet feeding apparatus 17 according to the present embodiment includes at least the sheet feeding tray 21, the side regulation plate 22, the extension tray 23, the sheet feeding unit 25, and the attachment portion 29.

Figure 3:
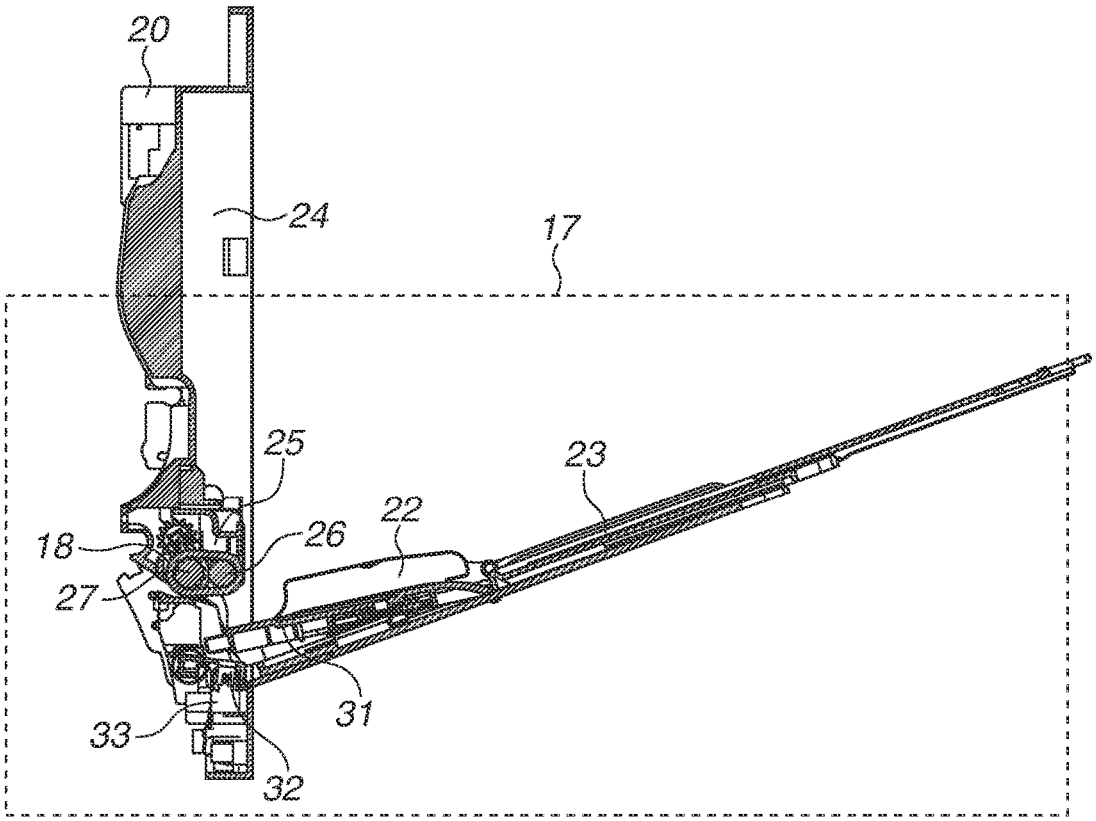
FIG. 3 is a cross-sectional view illustrating the structure of the right door including a multi-sheet feeding apparatus.
Figure 4:
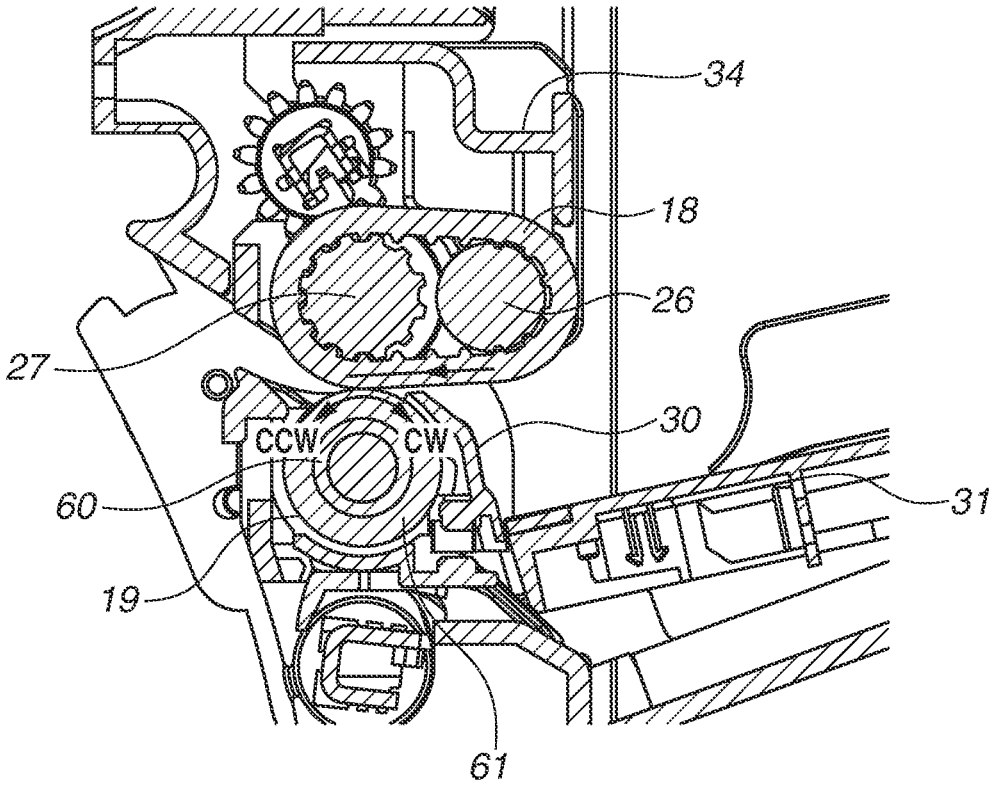
FIG. 4 illustrates in detail the structure of the vicinity of a sheet feeding unit.

FIG. 3 is a cross-sectional view illustrating the right door 20 including the multi-sheet feeding apparatus 17. FIG. 4 illustrates in detail a portion of the multi-sheet feeding apparatus 17 around the sheet feeding belt 18.

The sheet feeding belt 18 is an elastic, endless belt (rubber, etc.) and feeds a sheet stacked on the sheet feeding tray 21 to a downstream area in a sheet conveying direction. The inner periphery of the sheet feeding belt 18 is supported by a pick-up core 26 and a feed core 27. The pick-up core 26 is a first rotary member disposed upstream in a sheet feeding direction. The feed core 27 is a second rotary member disposed downstream in the sheet feeding direction. The sheet feeding unit 25 includes at least the sheet feeding belt 18, the pick-up core 26, the feed core 27, a driving input member 27*b* described below, and a holding device 34 which pivotably supports and holds the pick-up core 26 and a rotation shaft of the pick-up core 26 (refer to FIG. 5 for the holding device 34). Further, the sheet feeding unit 25 includes the driving input member 27*b* and a belt regulation member 27*c*. The driving input member 27*b* is provided at one end of the feed core 27 in a width direction which intersects with the direction in which the sheet feeding belt 18 is moved, and the belt regulation member 27*c* is provided at the other end of the feed core 27 in the width direction. The belt regulation member 27*c* includes a regulation surface which is in contact with an end surface of the sheet feeding belt 18 to regulate lateral shifts in the width direction of the sheet feeding belt 18.

The separation roller 19 is the separation device which separates the stacked sheets one by one. The separation roller 19 is disposed to face the sheet feed core 27 via the sheet feeding belt 18. The separation roller 19 includes a separation roller core 60 (third rotary member) and a separation roller rubber 61 (separation belt). The separation roller core 60 includes a built-in torque limiter which generates a predetermined torque. The separation roller rubber 61 is press-fitted to the outer periphery portion of the separation roller core 60. Further, the separation roller 19 is provided in such a way that the separation roller 19 is freely rotatable through the intervention of the torque limiter. The separation roller 19 is provided to face the feed core 27 via the sheet feeding belt 18. The separation roller 19 is pressed against the sheet feeding belt 18 with a predetermined pressure by a separation roller holder 45 (FIG. 7) and a separation spring 46 (FIG. 7) described below.

The torque value of the torque limiter and the pressure of the separation spring 46 (FIG. 7) are selected to satisfy the following conditions. When there is either only one sheet or no sheet in a separation nip portion formed by the sheet feeding belt 18 and the separation roller 19, the separation roller 19 is operated by a frictional force to follow the sheet feeding belt 18. Further, when the sheet feeding belt 18 is stopped, the separation roller 19 is stopped. Only when there are two or more sheets in the separation nip portion, the separation roller 19 is rotated backward (driving transmission will be described below) to produce a return force. The torque value of the torque limiter and the pressure of the separation spring 46 are selected to satisfy the above-described conditions.

A separation guide 30 guides a sheet S conveyed by the sheet feeding belt 18 in such a way that the leading edge of the sheet S is smoothly brought into the separation nip portion.

An elevating/lowering device is an intermediate plate 31 which elevates and lowers the sheets stacked on the sheet feeding tray 21. The intermediate plate 31 has a rotation center at the sheet feeding tray 21 and is provided in such a way that the intermediate plate 31 can swing to press the uppermost surface of the sheets stacked on the sheet feeding tray 21 against the pick-up core 26 via the sheet feeding belt 18. The intermediate plate 31 is pressed against the sheet feeding belt 18 by a lift arm (FIG. 6) and an intermediate plate spring 33 (FIG. 6) described below.

Figure 5A:
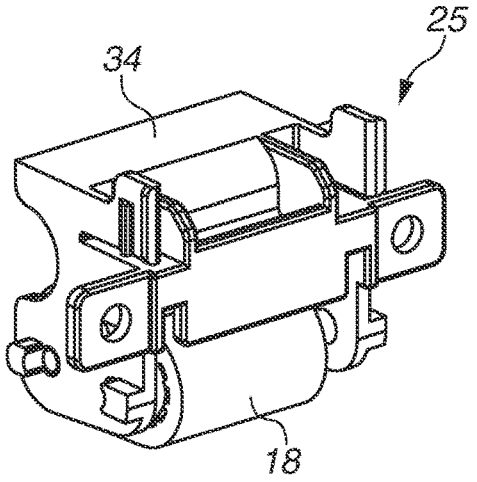
FIGS. 5A to 5C illustrate components of the sheet feeding unit.
Figure 5B:
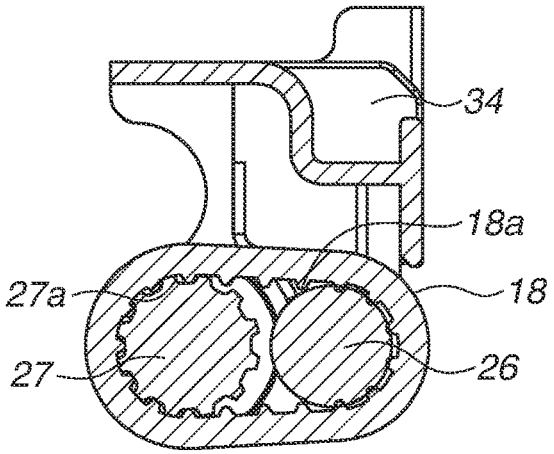
Figure 5C:
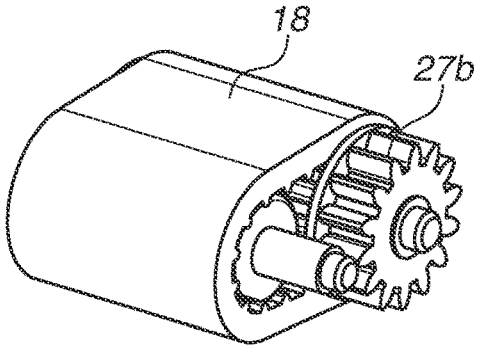

Next, the sheet feeding unit 25, which is a feature of the present structure, will be described in detail below with reference to FIGS. 5A to 5C. FIGS. 5A to 5C each illustrate the structure of the sheet feeding unit 25 in detail. FIG. 5A is a perspective view. FIG. 5B is a cross-sectional view. FIG. 5C is a perspective view illustrating the sheet feeding unit 25 without the holder 34 which is the holding device.

The holder 34 holds the shafts of the pick-up core 26 and the feed core 27 to pivotably support the shafts so that the pick-up core 26 and the feed core 27 can rotate. The rotation shafts of the pick-up core 26 and the feed core 27 are held by the holder 34 to maintain a constant distance between the shafts. The sheet feeding belt 18 is supported by the two shafts, which are the shaft of the pick-up core 26 and the shaft of the feed core 27, in such a way that the inner periphery surface of the sheet feeding belt 18 is supported along the two shafts. For this reason, the outer periphery of the sheet feeding belt 18 has an oval shape as illustrated in FIG. 5B.

Further, the sheet feeding belt 18 has an inner periphery surface including a plurality of protruding and depressed portions for driving transmission. Specifically, triangular protruding portions 18*a* (inner periphery toothed surface 18*a*) protruding across the width direction of the sheet feeding belt 18 are evenly provided at predetermined intervals in a rotation direction as the plurality of protruding and depressed portions (portions between the triangular protruding portions are the depressed portions). Further, the feed core 27 has an outer periphery portion including a feed core toothed surface 27*a* formed as protruding and depressed portions (protruding and depressed driving portions) corresponding to the inner periphery toothed surface 18*a* of the sheet feeding belt 18.

Further, a feed core driving gear 27*b* which is a driving member is provided on a portion of the feed core 27 that is located outside the sheet feeding belt 18. The feed core driving gear 27*b* receives a driving force input from the main body of the image forming apparatus 1 to play a role to rotate the feed core 27. The feed core toothed surface 27*a* meshes with the inner periphery toothed surface 18*a* of the sheet feeding belt 18 to allow the sheet feeding belt 18 to be rotated without causing the feed core 27 and the sheet feeding belt 18 to slip. The sheet feeding belt is rotated (in a direction of an arrow in FIG. 4) so that the sheet S is stably conveyed into the main body of the image forming apparatus 1 by the sheet feeding belt 18. The outer periphery surface of the pick-up core 26 does not include a plurality of protruding and depressed portions, and the pick-up core 26 is a driven roller which is driven and rotated by a contact pressure of the inner periphery toothed surface 18*a* of the sheet feeding belt 18 and the pick-up core 26.

Figure 6A:
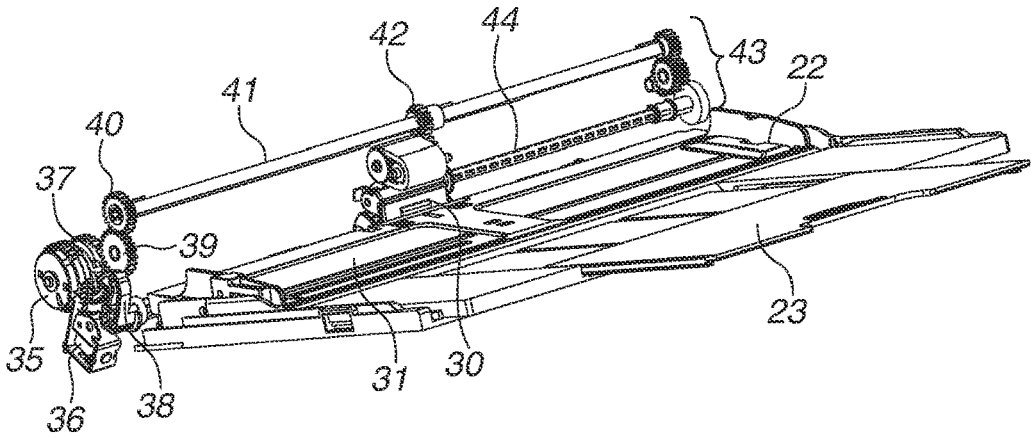
FIGS. 6A to 6C illustrate the driving transmission structure of the multi-sheet feeding apparatus.
Figure 6B:
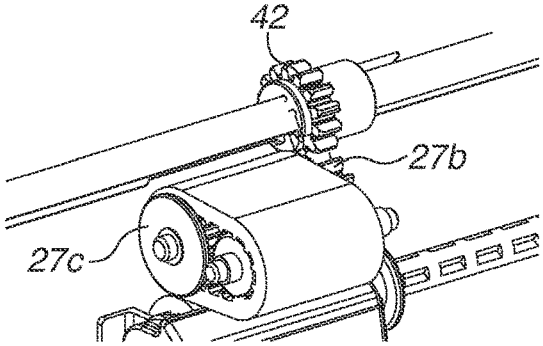
Figure 6C:
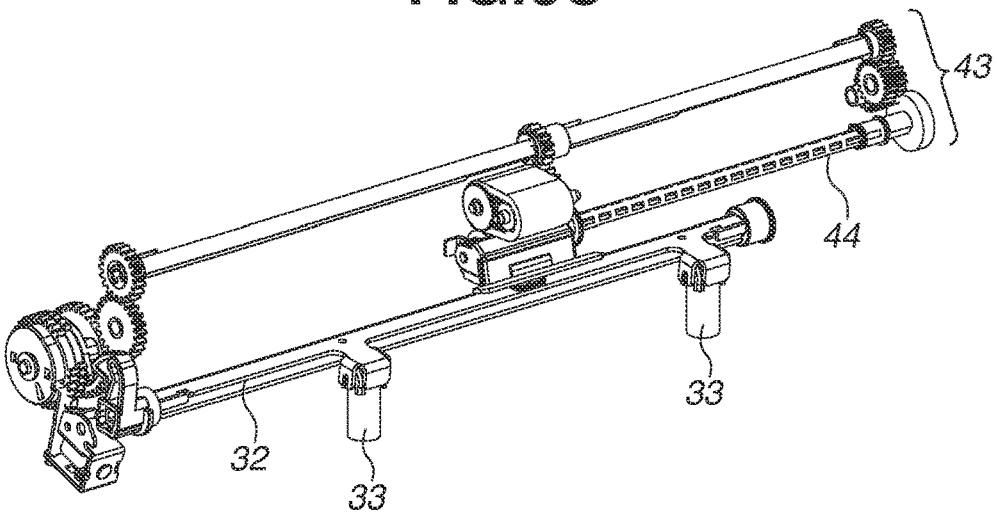

Next, the structure of driving transmission to the sheet feeding belt 18, the structure of applying pressure from the intermediate plate 31, and the operation of feeding sheets at the sheet feeding belt 18 will be described below with reference to FIGS. 6A to 6C. Further, the rotation direction around the sheet feeding belt 18 will also be described below with reference to FIG. 4. FIG. 6A is a perspective view illustrating the structure of transmission for driving the multi-sheet feeding apparatus 17. FIG. 6B illustrates in detail the vicinity of the sheet feeding unit 25. FIG. 6C is a perspective view illustrating the transmission structure with the intermediate plate 31 being removed.

First, the driving transmission structure will be described below. The right door 20 includes a multi-control gear 35 and a solenoid 36 to control the sheet feeding operation using single-rotation control and controls the timing to feed a sheet from the multi-sheet feeding apparatus 17. The multi-control gear 35 is a toothless gear including a built-in spring clutch mechanism.

An intermediate plate elevating/lowering control cam 37 is provided at the multi-control gear 35. A sheet feeding belt driving shaft 41 is connected to be driven via the multi-sheet feeding gear 35, an idler gear 39, and a sheet feeding shaft driving gear 40. A belt connection gear 42 is provided on a central portion of the belt driving shaft 41 to drive the sheet feeding belt 18. The feed core 27 includes the feed core driving gear 27*b* to allow driving transmission to the belt connection gear 42. As described above, the outer periphery surface of the feed core 27 includes the feed core toothed surface 27*a*, and the feed core toothed surface 27*a* meshes with the inner periphery toothed surface 18*a* of the sheet feeding belt 18 to transmit the driving to the sheet feeding belt 18.

As illustrated in FIG. 6A, the belt driving shaft 41 extends from the side on which the multi-control gear 35 is disposed to the opposite end portion of the apparatus, and transmits the driving to a separation roller driving member 43 configured to drive the separation roller 19. A separation roller driving shaft 44 has a coupling shape to receive the driving from the separation roller driving member 43 and pivotably support the separation roller 19, and engages with the separation roller core 60 of the separation roller 19. The driving rotation direction at the separation roller core 60 is a direction CW (FIG. 4), and in a case in which the separation roller 19 does not nip the sheet feeding belt 18, the driving rotation direction is the same as the direction CW (FIG. 4) of the separation roller core 60.

Next, the structure of the press of the intermediate plate 31 and the structure of the elevating/lowering operation will be described below. The lift arm 32 as an intermediate plate pressing member has a rotation center at the right door 20. The intermediate plate spring 33 is provided on a lower surface of the lift arm 32 to generate a pressure with which the intermediate plate 31 presses the sheet feeding belt 18. The intermediate plate spring 33 is set to apply an appropriate pressure regardless of whether a maximum number of sheets S are stacked or a few sheets S are stacked.

An elevating/lowering cam follower 38 is provided on an end portion of the lift arm 32 that is on the multi-control gear 35 side. The intermediate plate elevating/lowering control cam 37 is in contact with the cam follower 38, and as the intermediate plate elevating/lowering control cam 37 is rotated, the lift arm 32 performs elevating/lowering operations according to the shape of the cam follower 38 and the spring pressure of the intermediate plate spring 33.

Next, the operation of feeding and separating sheets performed by the above-described driving transmission structure and the structure of the press of the intermediate plate 31 will be described below. When an instruction to start printing is given by the user, a control mechanism (not illustrated) starts rotating a sheet feeding motor (driving source) (not illustrated) provided in the main body of the image forming apparatus 1. Thereafter, when the solenoid 36 is turned on, a spring (not illustrated) provided in the multi-control gear 35 rotates the multi-control gear 35.

When the multi-control gear 35 is rotated, the intermediate plate elevating/lowering control cam 37 provided at the multi-control gear 35 also starts rotating together, and the intermediate plate elevating/lowering control cam 37 is rotated from an intermediate plate separated position to an intermediate plate pressing position. At this time, the cam follower 38 being in contact with the intermediate plate elevating/lowering control cam 37 and the lift arm 32 are caused to start rotating by the pressing force of the intermediate plate spring 33. When the lift arm 32 is rotated, the intermediate plate 31 is moved to press a portion of the sheet feeding belt 18 that is in contact with the pick-up core 26. Consequently, the uppermost sheet among the sheets stacked on the sheet feeding tray 21 is pressed against the sheet feeding belt 18.

When the multi-control gear 35 is further rotated, the idler gear 39 meshes with the multi-control gear 35 so that the sheet feeding shaft driving gear 40, the belt driving shaft 41, the belt connection gear 42, and the feed core driving gear 27*b* start rotating. When the feed core 27 starts rotating, the feed core toothed surface 27*a* provided on the outer periphery surface of the feed core 27 meshes with the inner periphery toothed surface 18*a* of the sheet feeding belt 18 so that the sheet feeding belt 18 starts rotating in the direction of the arrow specified in the sheet feeding belt 18 in FIG. 4.

Thereafter, the sheet pressed against the sheet feeding belt 18 on the side of the pick-up core 26 by the intermediate plate spring 33 is started being conveyed toward the main body of the apparatus and guided by the separation guide 30 to the separation nip portion formed by the sheet feeding belt 18 on the side of the feed core 27 and the separation roller 19.

When the leading edge of the sheet is conveyed to the separation nip portion formed by the sheet feeding belt 18 on the side of the feed core 27 and the separation roller 19, the separation roller 19 operates as described below to convey the sheet one by one to the image forming apparatus 1.

As described above, the driving is transmitted to the separation roller core 60 in the direction CW (FIG. 4) to convey the sheet S in the direction opposite to the sheet feeding direction. When the sheet is conveyed one by one to the separation nip portion, the built-in torque limiter of the separation roller core 60 operates to rotate the separation roller 19 in a direction CCW (FIG. 4) which is the sheet feeding direction. When a plurality of sheets is brought into the separation nip portion, the torque limiter in the separation roller core 60 does not operate, so the separation roller 19 is rotated in the direction CW (FIG. 4), which is the direction opposite to the sheet feeding direction. As a result of the rotation operation, the sheets excluding the uppermost sheet are returned to the sheet feeding tray 21 side.

When the leading edge of the sheet is conveyed to the drawing roller 16 (FIG. 1) during the above-described separation operation, the intermediate plate elevating/lowering control cam 37 of the multi-control gear 35 is rotated to the intermediate plate separated position. Then, the intermediate plate elevating/lowering control cam 37 rotates the cam follower 38 to move apart the intermediate plate 31. The intermediate plate 31 is moved apart to retract the sheet from the sheet feeding belt 18 on the side of the pick-up core 26, so the sheet conveyance on the sheet feeding belt 18 on the side of the pick-up core 26 is ended. Then, when the multi-control gear 35 is rotated up to a notch portion of the multi-control gear 35, the driving received by the sheet feeding belt 18 from the multi-control gear 35 is disconnected, and the rotation of the multi-control gear 35 is stopped by the solenoid 36.

The conveyance of the sheet to the image forming unit is continued by the drawing roller 16 (FIG. 1). The sheet feeding belt 18 on the side of the feed core 27 and the separation roller 19 continue to form the separation nip portion, so the sheet feeding belt 18 is rotated clockwise in FIG. 4 by the force of the sheet S. Since the sheet feeding belt 18 is rotated, the inner periphery toothed surface 18*a* of the sheet feeding belt 18 meshes with the feed core toothed surface 27*a* to transmit the driving to the feed core driving gear 27*b*, the belt connection gear 42, the belt driving shaft 41, the separation driving member 43, the separation shaft 44, and the separation roller core 60 in this order. Thus, even when the multi-control gear 35 is not driven, the driving is transmitted to the separation roller core 60, so the separation function at the separation roller 19 is maintained.

Then, after the sheet passes through the separation nip portion, the rotation of the sheet feeding belt 18 is stopped, and the sheet feeding operation is completed.

Next, the positional relationship between a pick-up portion (sheet feeding nip portion) formed by the pick-up core 26 of the sheet feeding belt 18 and the intermediate plate 31 and the separation nip portion (second contact portion) formed by the feed core 27 and the separation roller 19 will be described below with reference to FIG. 7.

Figure 7:
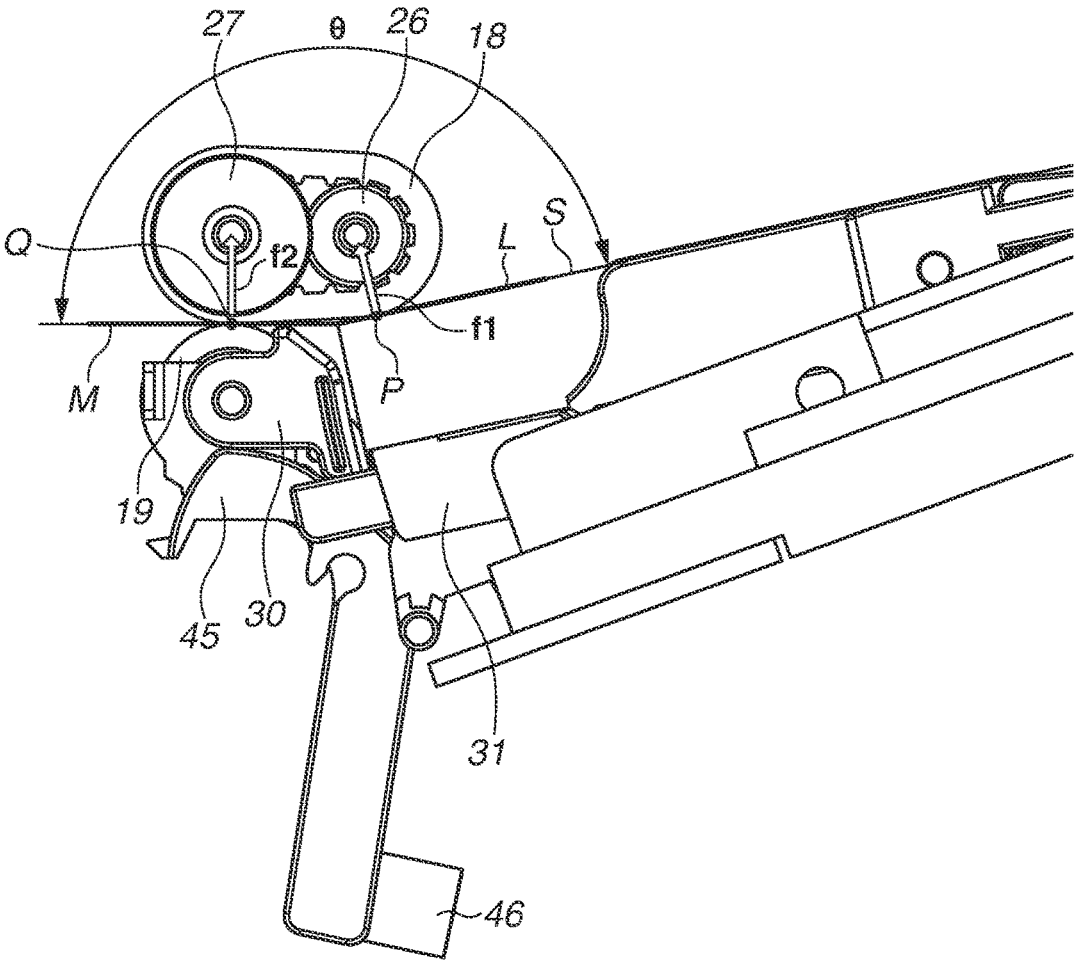
FIG. 7 illustrates how a separation roller is pressed against a sheet feeding belt and how a sheet S is pressed against the sheet feeding belt by an intermediate plate.

FIG. 7 illustrates the state in which sheets are stacked on the sheet feeding tray 21 and the intermediate plate 31 presses the uppermost sheet S against the sheet feeding belt 18 on the side of the pick-up core 26.

In FIG. 7, a point P indicates the point at which the intermediate plate 31 presses the uppermost sheet S against the sheet feeding belt 18 on the side of the pick-up core 26, and a point Q indicates the separation nip portion. First, the structure of the press at the point P will be described below. As described above, the lift arm 32 and the intermediate plate spring 33 on the lower surface of the lift arm 32 cause the intermediate plate 31 to press the sheet feeding belt 18. The direction in which the intermediate plate 31 presses the surface of the uppermost sheet S among the sheets stacked on the sheet feeding tray 21 against the pick-up core 26 at the press point P via the sheet feeding belt 18 is the direction of an arrow f1 which is the rotation center direction of the pick-up core 26.

Next, the structure of the press at the point Q will be described below. The separation roller holder 45 is pivotably supported in such a way that the separation roller holder 45 can swing with respect to the right door 20 which holds the separation roller 19. One end surface of the separation spring 46 is disposed at the separation roller holder 45, and the other end surface of the separation spring 46 is disposed at the right door 20. The separation roller 19 is configured to be pressed against the sheet feeding belt 18 with a predetermined pressure by the separation roller holder 45 and the separation spring 46. The direction in which the separation roller 19 is pressed against the sheet feeding belt 18 by the separation spring 46 is the direction of an arrow f2 which is the rotation center direction of the feed core 27. In this way, a retard pressure can be applied without being affected by the flexion of the sheet feeding belt 18.

Tangent lines from the points P and Q to the circular arc surface of the sheet feeding belt 18 will be referred to as straight lines L and M, respectively. The closer the angle θ formed by the straight lines L and M is to 180 degrees, the smaller the effect of stiffness of the uppermost sheet S becomes when the uppermost sheet S is conveyed from the point P to the point Q by the sheet feeding belt 18. If the angle θ becomes smaller than 180 degrees, the stiffness of the uppermost sheet S has a larger effect. Especially in a case of a thick stiff sheet, it is difficult to rapidly bend the sheet, so a sheet feeding failure can occur.

According to the present embodiment, the angle θ is set to 170 degrees. This allows the sheets to be conveyed substantially without being affected by the stiffness of the uppermost sheet S. Further, in a case of conveying a sheet which is curled downward, an angle θ closer to 180 degrees is beneficial. When a sheet that is already fed once is reused, the sheet may be curled depending on the type of the sheet. Even in such a case, the sheet can be conveyed without issue.

Figure 8:
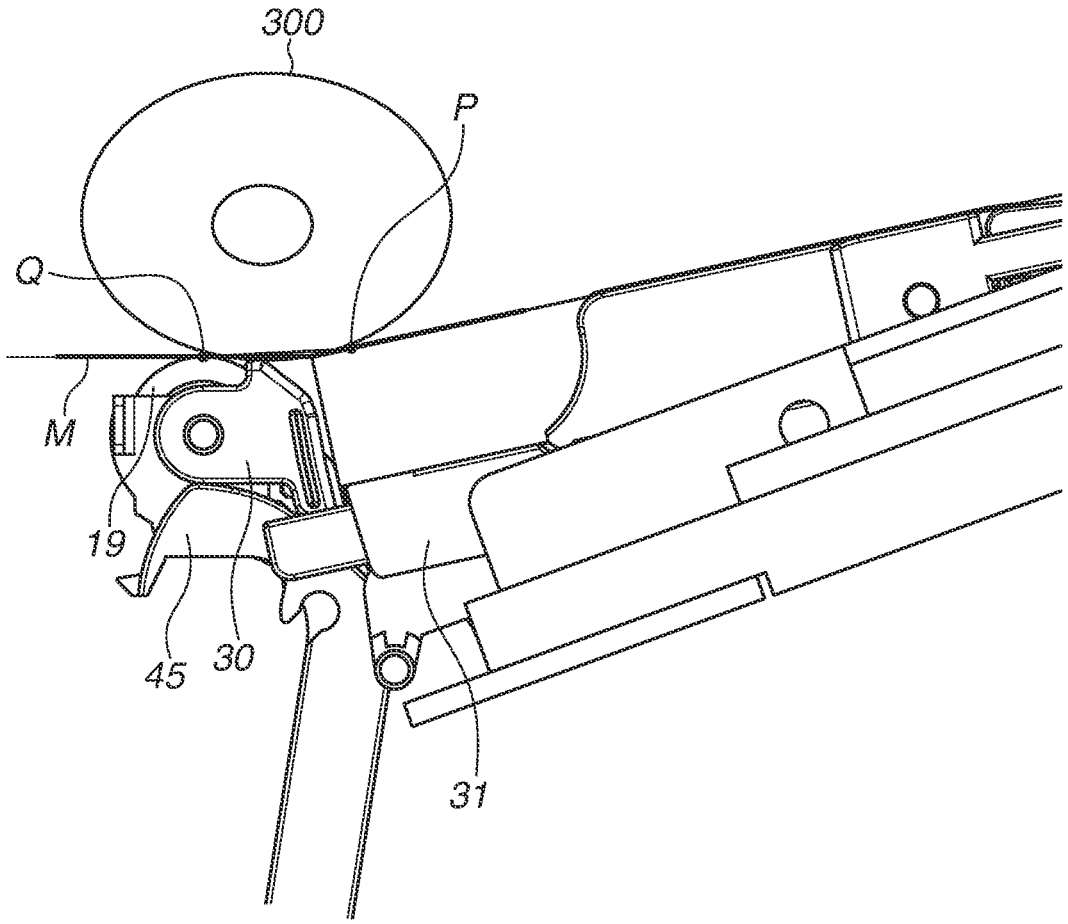
FIG. 8 illustrates how a separation roller is pressed against a sheet feeding roller and how a sheet S is pressed against the sheet feeding roller by an intermediate plate according to a comparative example.

Further, FIG. 8 illustrates a structure according to a comparative example in which a sheet feeding roller 300 is provided in place of the sheet feeding belt 18 according to the present embodiment. In the case in which one sheet feeding roller 300 is provided, a space is needed because the sheet feeding roller 300 needs to be large in size for the following reason. Specifically, to perform the sheet feeding and the separation, the points P and Q need to be formed by a single sheet feeding roller, and as illustrated in FIG. 8, the sheet feeding roller 300 having a large diameter is needed. Furthermore, another space above the sheet feeding roller 300 is also needed. This leads to an increase in size of the image forming apparatus 1.

Further, according to the present embodiment, the feed core 27 has the feed core toothed surface 27*a* for transmitting the driving to the sheet feeding belt 18. A benefit of this arrangement will be described below with reference to FIG. 7.

When the driving is transmitted from the feed core driving gear 27*b* to the feed core toothed surface 27*a*, the feed core toothed surface 27*a* meshes with the inner periphery toothed surface 18*a* of the sheet feeding belt 18. The sheet feeding belt 18 is pressed by the driving feed core 27 (near the point Q) and the point P which is another press point, and when the feed core 27 receives the driving, the sheet feeding belt 18 made of a rubber material is extended between the points P and Q.

If a toothed surface is formed on the outer periphery of the pick-up core 26 to mesh with the inner periphery toothed surface 18*a* of the sheet feeding belt 18, the sheet feeding belt 18 pressed at the points P and Q sags between the points P and Q. As a result, a sheet cannot be conveyed to the separation roller 19 at a desired angle, and the sheet is not successfully conveyed. By forming the toothed surface on the feed core 27 side, a sheet can be stably conveyed without causing such a disadvantage.

Further, the intermediate plate 31 presses the point P of the sheet feeding belt 18 described above. At the point P, the pick-up core 26 is present inside, so the sheet feeding belt 18 does not sag significantly, and the position at which the sheet feeding belt 18 is pressed does not change regardless of whether many sheets are stacked or a few sheets are stacked. For this reason, the pressure can be managed only at the intermediate plate spring 33.

If the sheet feeding belt 18 is pressed downstream of the point P where the pick-up core 26 is not present, the sheet feeding belt 18 is bent inward. For this reason, not only the flexion of the intermediate plate spring 33 but also the flexion of the sheet feeding belt 18 need to be taken into consideration. Further, the compression amount of the intermediate plate spring 33 changes according to whether many sheets are stacked or a few sheets are stacked, so the amount of flexion of the sheet feeding belt 18 also changes. For this reason, the management of the pressure with which the sheet S is pressed against the sheet feeding belt 18 via the intermediate plate 31 becomes complicated. By applying the pressure of the sheet S to the sheet feeding belt 18 on the side of the pick-up core 26 via the intermediate plate 31, the pressure can be stabilized so that the stability of the sheet feeding operation can be refined regardless of whether many sheets are stacked or a few sheets are stacked.

Further, as described above, the inner periphery toothed surface 18*a* comes into contact with and along the outer periphery surfaces of the pick-up core 26 and the feed core 27 to support the sheet feeding belt 18. For this reason, the outer periphery of the sheet feeding belt 18 has an oval shape. The sheet feeding belt 18 has an oval shape so that a space in an upper part of the apparatus does not have to be used, compared to conventional circular sheet feeding rollers. Therefore, the space in the upper part can be used for other purposes. For example, a sheet conveying guide or a component having a shape for increasing the rigidity of the right door 20 can be provided in the space. This contributes to the size reduction of the entire image forming apparatus 1.

While the angle θ formed by the straight lines L and M is set to 170 degrees according to the first embodiment, the angle θ is not limited to 170 degrees.

Further, while the driving is transmitted to the separation roller 19 according to the first embodiment, a separation pad method by which no driving transmission to the separation roller 19 is conducted can be employed depending on the purpose of use of sheets in the main body of the image forming apparatus 1.

Figure 9:
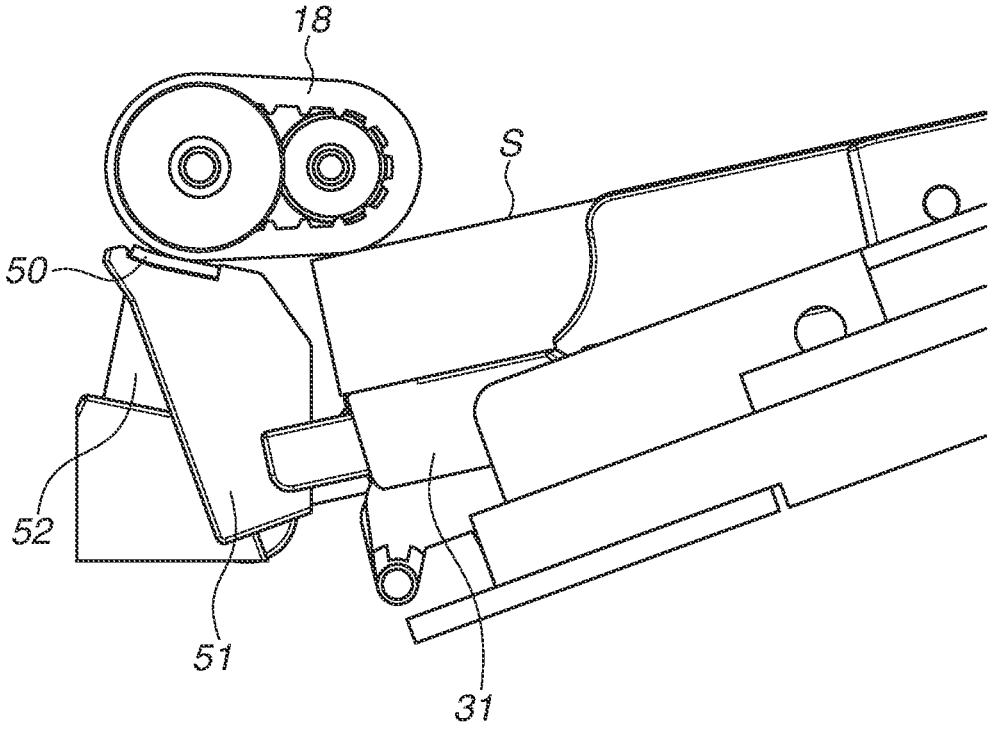
FIG. 9 illustrates the structure of a separation pad used as a separation device according to a modified example of the first embodiment.

A modified example of the present embodiment will be described below with reference to FIG. 9. FIG. 9 is a cross-sectional view schematically illustrating a multi-sheet feeding apparatus including a separation pad 50 as the separation device in place of the separation roller 19. The separation device according to the modified example includes a separation pad 50, a separation pad holder 51 which holds the separation pad 50, and a separation pad pressing spring 52. The separation pad pressing spring 52 presses the sheet feeding belt 18 via the separation pad holder 51 and the separation pad 50. The direction of the press is the rotation center direction of the feed core 27. Use of the separation pad 50 makes it unnecessary to transmit the driving to the separation device, so the structure can be simplified.

Figure 10:
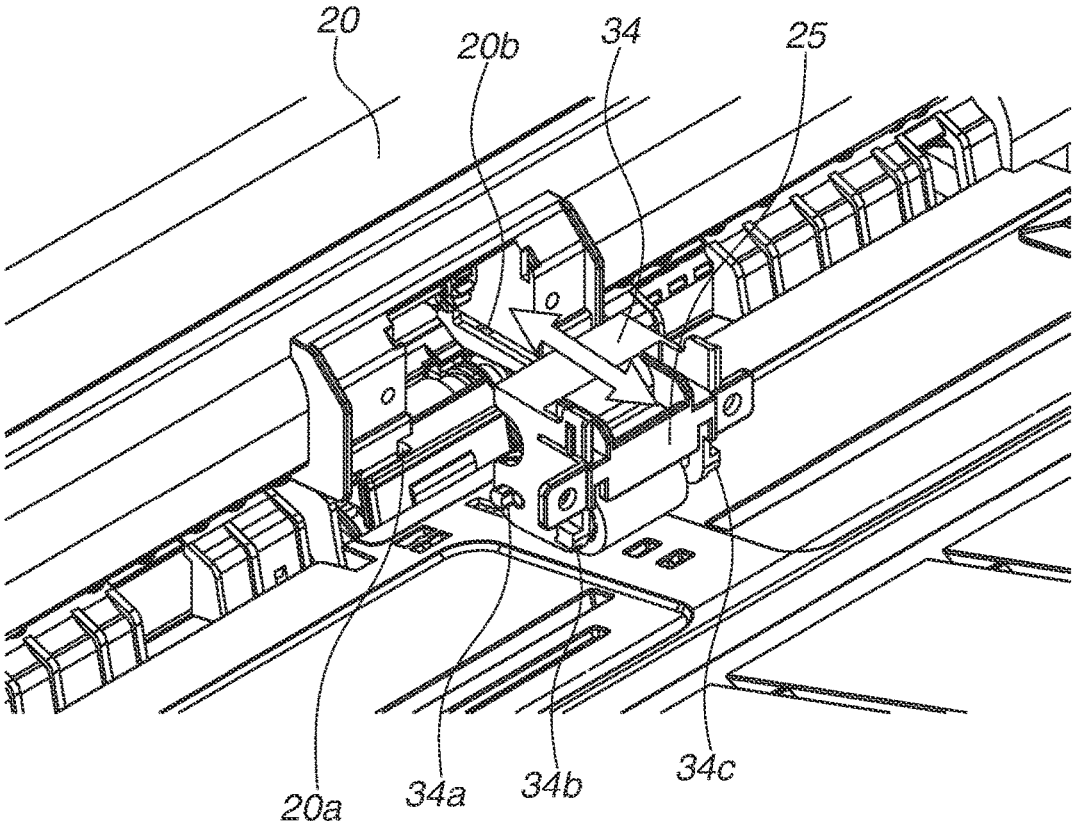
FIG. 10 illustrates the attachment and removal of the sheet feeding unit to and from the right door.

Next, the structure of removal and attachment of the sheet feeding unit 25 will be described below. FIG. 10 illustrates the structure of removal and attachment of the sheet feeding unit 25. The holder 34 of the sheet feeding unit 25 includes guide ribs 34*a* and 34*b* for positioning and guiding, a guide rib 34*c*, and a guide rib (not illustrated) disposed to face the guide rib 34*a*. The first two guide ribs, namely the guide ribs 34*a* and 34*b*, are disposed on the front side in FIG. 10, and the last two guide ribs, namely the guide rib 34*c* and the guide rib that is not illustrated, are disposed on the far side in FIG. 10. The right door 20 includes guide grooves 20*a* (front side in FIG. 10) and 20*b* (far side in FIG. 10) for guiding the sheet feeding unit 25.

The structure of the front side in FIG. 10 will be described below to describe the operation of replacement. To attach the sheet feeding unit 25 to the right door 20, the guide rib 34*a* of the holder 34 is fitted to the guide groove 20*a* of the right door 20. Then, the sheet feeding unit 25 is pushed in the direction of the right door 20 specified by an arrow so that the other guide rib 34*b* is placed on the guide groove 20*a*. In this way, the position of the sheet feeding unit 25 in the height direction is determined. The guide rib 34*c* and the guide groove 20*a* on the far side in FIG. 10 have a similar relationship. After the sheet feeding unit 25 is pushed, the positions of the right door 20 and the sheet feeding unit 25 in the sheet feeding direction are fixed by a screw (not illustrated). To remove the sheet feeding unit 25, the above-described procedure is performed in a reversed order. While the foregoing describes that the position of the sheet feeding unit 25 in the sheet feeding direction is fixed with the screw, a snap-fit shape can be formed, or a bolt shape can be formed using a different component.

Figure 11:
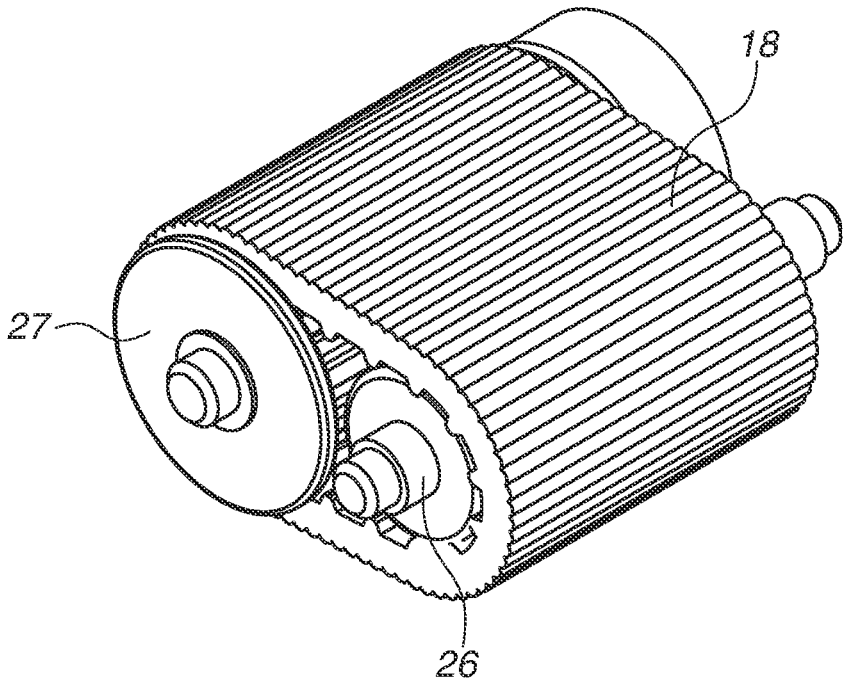
FIG. 11 illustrates a modified example of the sheet feeding belt.

A modified example of the sheet feeding belt 18 will be described below with reference to FIG. 11. FIG. 11 illustrates the sheet feeding unit 25 without the holder 34. The sheet feeding belt 18 includes an outer periphery surface having a knurled shape with fine protrusions and depressions formed in the sheet feeding direction. Use of the knurled shape may address an issue where components (e.g., paper dust) attached to the sheet are attached to the sheet feeding belt 18 to cause a slip.

While the manual sheet feeding apparatus 17 is described as an example of the sheet feeding apparatus in the present embodiment, application of an embodiment of the disclosed information is not limited to the above-described application. An embodiment of the disclosed information is also applicable to, for example, the first sheet feeding apparatus 101 of the image forming apparatus 1 illustrated in FIG. 1.

Further, while the example in which an embodiment of the disclosed information is applied to the electrophotographic image forming apparatus is described in the present embodiment, application of an embodiment of the disclosed information is not limited to the above-described application. An embodiment of the disclosed information is also applicable to, for example, an image forming apparatus using a method other than the electrophotographic method, such as an inkjet image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-211022, filed Oct. 27, 2016, which is hereby incorporated by reference herein in its entirety.

What is claimed is:

1. A sheet feeding unit attachable to and removable from a sheet feeding apparatus configured to feed a sheet, the sheet feeding unit comprising:

an endless belt configured to be brought into contact with a sheet stacked on a stacking device to feed the sheet;

a first rotary member configured to come into contact with an inner periphery of the endless belt to support the endless belt;

a second rotary member configured to come into contact with the inner periphery of the endless belt to support the endless belt and disposed to cause a separation device and the endless belt to separate sheets one by one; and a holding device configured to hold the first rotary member and the second rotary member, wherein the endless belt includes a first plurality of protruding and depressed portions on the inner periphery of the endless belt, the second rotary member includes a second plurality of protruding and depressed portions, and the first rotary member does not include a protruding portion or a depressed portion, and wherein, to rotate the endless belt to feed the sheet in contact with the endless belt, the first plurality of protruding and depressed portions meshes with the second plurality of protruding and depressed portions to transmit a driving force from the second plurality of protruding and depressed portions to the endless belt.

2. The sheet feeding unit according to claim 1, wherein the first rotary member faces, via the endless belt, an elevating/lowering device configured to bring the sheet stacked on the stacking device into contact with the endless belt.

3. The sheet feeding unit according to claim 2, wherein the first rotary member forms, with the elevating/lowering device via the endless belt, a sheet feeding nip portion to feed the sheet.

4. The sheet feeding unit according to claim 3, wherein the second rotary member forms, with the separation device via the endless belt, a separation nip portion to separate, from the endless belt, a subsequent sheet which is in contact with, and conveyed by, the endless belt.

5. The sheet feeding unit according to claim 1, wherein the endless belt is an elastic belt and in a stretched state via only the first rotary member and the second rotary member.

6. The sheet feeding unit according to claim 5, wherein the first rotary member includes a smooth surface that follows the rotation of the endless belt and does not mesh with the first plurality of protruding and depressed portions.

7. The sheet feeding unit according to claim 1, wherein a rotation shaft of the first rotary member and a rotation shaft of the second rotary member are held by the holding device in such a way that a distance between the rotation shafts of the first and second rotary members is maintained.

8. The sheet feeding unit according to claim 1, wherein the second rotary member includes a driven gear configured to mesh with a driving gear to be rotated by a driving source included in the sheet feeding unit, and wherein the driven gear is supported by the second rotary member at a position, outside one end of the second rotary member and the endless belt such that, in a width direction intersecting with a direction in which the endless belt is moved, the driven gear is not in contact with the inner periphery of the endless belt.

9. The sheet feeding unit according to claim 1, wherein the first plurality of protruding and depressed portions has a knurled shape, and wherein an outer periphery of the endless belt has a knurled shape.

10. The sheet feeding unit according to claim 1, wherein the holding device includes a guide portion to guide the sheet feeding unit when the sheet feeding unit is being attached on the sheet feeding apparatus.

11. A sheet feeding apparatus configured to feed a sheet, the sheet feeding apparatus comprising:

a stacking device on which a sheet is to be stacked;

a sheet feeding unit including an endless belt; and an elevating/lowering device configured to bring the sheet stacked on the stacking device into contact with the endless belt, wherein the sheet feeding unit includes:

the endless belt configured to be brought into contact with the sheet stacked on a stacking device to feed the sheet, a first rotary member configured to come into contact with an inner periphery of the endless belt to support the endless belt, a second rotary member configured to come into contact with the inner periphery of the endless belt to support the endless belt and disposed to cause a separation device and the endless belt to separate sheets one by one, and a holding device configured to hold the first rotary member and the second rotary member, wherein the endless belt includes a first plurality of protruding and depressed portions on the inner periphery of the endless belt, the second rotary member includes a second plurality of protruding and depressed portions, and the first rotary member does not include a protruding portion or a depressed portion, and wherein, to rotate the endless belt to feed the sheet in contact with the endless belt, the first plurality of protruding and depressed portions meshes with the second plurality of protruding and depressed portions to transmit a driving force from the second plurality of protruding and depressed portions to the endless belt.

12. An image forming apparatus comprising:

an image forming unit configured to form an image to be transferred onto a sheet;

a stacking device on which a sheet is to be stacked;

a sheet feeding unit including an endless belt; and an elevating/lowering device configured to bring the sheet stacked on the stacking device into contact with the endless belt, wherein the sheet feeding unit includes:

the endless belt configured to be brought into contact with the sheet stacked on a stacking device to feed the sheet, a first rotary member configured to come into contact with an inner periphery of the endless belt to support the endless belt, a second rotary member configured to come into contact with the inner periphery of the endless belt to support the endless belt and disposed to cause a separation device and the endless belt to separate sheets one by one, and a holding device configured to hold the first rotary member and the second rotary member, wherein the endless belt includes a first plurality of protruding and depressed portions on the inner periphery of the endless belt, the second rotary member includes a second plurality of protruding and depressed portions, and the first rotary member does not include a protruding portion or a depressed portion, and wherein, to rotate the endless belt to feed the sheet in contact with the endless belt, the first plurality of protruding and depressed portions meshes with the second plurality of protruding and depressed portions to transmit a driving force from the second plurality of protruding and depressed portions to the endless belt.

13. The image forming apparatus according to claim 10, wherein the first rotary member faces, via the endless belt, the elevating/lowering device.

14. The image forming apparatus according to claim 13, wherein the first rotary member forms, with the elevating/lowering device via the endless belt, a sheet feeding nip portion to feed the sheet.

15. The image forming apparatus according to claim 14, wherein the second rotary member forms, with the separation device via the endless belt, a separation nip portion to separate from the endless belt, a subsequent sheet which is in contact with, and conveyed by, the endless belt.

16. The image forming apparatus according to claim 10, wherein the endless belt is an elastic belt and in a stretched state via only the first rotary member and the second rotary member.

17. The image forming apparatus according to claim 16, wherein the first rotary member includes a smooth surface that follows the rotation of the endless belt and does not mesh with the first plurality of protruding and depressed portions.

18. The image forming apparatus according to claim 10, wherein a rotation shaft of the first rotary member and a rotation shaft of the second rotary member are held by the holding device in such a way that a distance between the rotation shafts of the first and second rotary members is maintained.

19. The image forming apparatus according to claim 10, wherein the second rotary member includes a driven gear configured to mesh with a driving gear to be rotated by a driving source included in the sheet feeding unit, and wherein the driven gear is supported by the second rotary member at a position, outside one end of the second rotary member and the endless belt such that, in a width direction intersecting with a direction in which the endless belt is moved, the driven gear is not in contact with the inner periphery of the endless belt.

20. The image forming apparatus according to claim 10, wherein the first plurality of protruding and depressed portions has a knurled shape, and wherein an outer periphery of the endless belt has a knurled shape.

21. The image forming apparatus according to claim 10, wherein the holding device includes a guide portion to guide the sheet feeding unit when the sheet feeding unit is being attached on the sheet feeding apparatus.

* * * * *